United States Patent [19]

Giannetti et al.

[11] Patent Number: 4,638,580

[45] Date of Patent: Jan. 27, 1987

[54] PUBLICITY BOARD WITH ROTATING PRISMATIC MEMBERS

[75] Inventors: Anna Giannetti; Sergio Massa, both of Turin; Cesare Re, Reano, all of Italy

[73] Assignee: S.r.l. LO.GI.CAM - Lombarda General Engeenering Costruzioni Automatiche, Italy

[21] Appl. No.: 722,817

[22] Filed: Apr. 12, 1985

[30] Foreign Application Priority Data

Apr. 20, 1984 [IT] Italy ..... 53291/84[U]

[51] Int. Cl.[4] ..... G09F 11/02

[52] U.S. Cl. ..... 40/503; 40/473

[58] Field of Search ..... 40/503, 573, 473, 470, 40/466

[56] References Cited

U.S. PATENT DOCUMENTS

| | | | |
|---|---|---|---|
| 1,609,650 | 12/1926 | Lund | 40/503 X |
| 3,304,638 | 2/1967 | Grandell et al. | 40/473 |
| 3,726,032 | 4/1973 | Atkins | 40/473 |
| 3,921,321 | 11/1975 | Weiskopf | 40/473 |
| 4,381,616 | 5/1983 | Saxer | 40/503 |

FOREIGN PATENT DOCUMENTS

| | | |
|---|---|---|
| 394538 | 2/1933 | Belgium . |
| 865252 | 2/1953 | Fed. Rep. of Germany . |

*Primary Examiner*—Robert P. Swiatek
*Assistant Examiner*—Wenceslao J. Contreras
*Attorney, Agent, or Firm*—Anthony Niewyk; Albert L. Jeffers

[57] ABSTRACT

A publicity board provided with a plurality of rotatable prismatic members mounted side-by-side, each being arranged to carry portions of publicity images on its faces, and further provided with a meter for rotating the prismatic members about their respective longitudinal axes. The motor is coupled to the prismatic members by means of an operating shaft driven by the motor and carrying a plurality of radial rods such that they rotate, to each cooperate with respective appendices extending radially from an end pivot of each prismatic member, for the purpose of transmitting to this latter a rotation through an angle which is double the angle formed at the center by each face of said prismatic member.

12 Claims, 7 Drawing Figures

PUBLICITY BOARD WITH ROTATING PRISMATIC MEMBERS

BACKGROUND OF THE INVENTION

This invention relates to a publicity board with rotating prismatic members. In particular, the invention relates to a publicity board of the type comprising a plurality of side-by-side prismatic members, each of which possesses display faces for carrying respective portions of publicity images, and further comprising motion generator means arranged to rotate the prismatic members in such a manner as to cyclically cause the faces of each prismatic member to lie in a single display plane in order to wholly compose the respective publicity image. Publicity boards of the aforesaid type are particularly convenient in that they enable generally three publicity images to be presented in sequence in the same space, thus enabling the number of publicity messages directed towards the user to be tripled.

One of the drawbacks of publicity boards of the aforesaid type is the excessive complexity of the transmission systems used for transmitting motion from the motion generator means to the various prismatic members. In this respect, said motion transmission means are constituted by chains or belts, or alternatively worms and associated helical gears, which are of particularly high cost and require periodic maintenance.

SUMMARY OF THE INVENTION

The object of the present invention is to provide a publicity board comprising a motion transmission system which is particularly simple, reliable and substantially free from maintenance requirements. The aforesaid object is attained according to the present invention by a publicity board of the type comprising:

a plurality of side-by-side prismatic members, each of which possesses display faces for carrying respective portions of publicity images; and motion generator means arranged to cause said prismatic members, disposed with their longitudinal axes parallel, to rotate about their longitudinal axis so as to cyclically cause the faces of each prismatic member to lie in a single display plane in order to wholly compose the respective publicity image; characterised by comprising motion transmission means interposed between said motion generator means and each of said prismatic members, and constituted by:

first means angularly coupled to the drive shaft of said motion generator means and constituting essentially an operating shaft, the longitudinal axis of which lies in the plane defined by the longitudinal axes of said prismatic members and is perpendicular to them; and second means carried by an end pivet of each prismatic member and cooperating with said first means in order to be periodically rotated through an angle equal to double the angle formed at the centre by each face of said prismatic member.

BRIEF DESCRIPTION OF THE DRAWINGS

The present invention will be more apparent from the description of a preferred embodiment thereof given hereinafter by way of non-limiting example with reference to the accompanying drawings, in which.

DETAILED DESCRIPTION OF THE INVENTION

Figure 1:
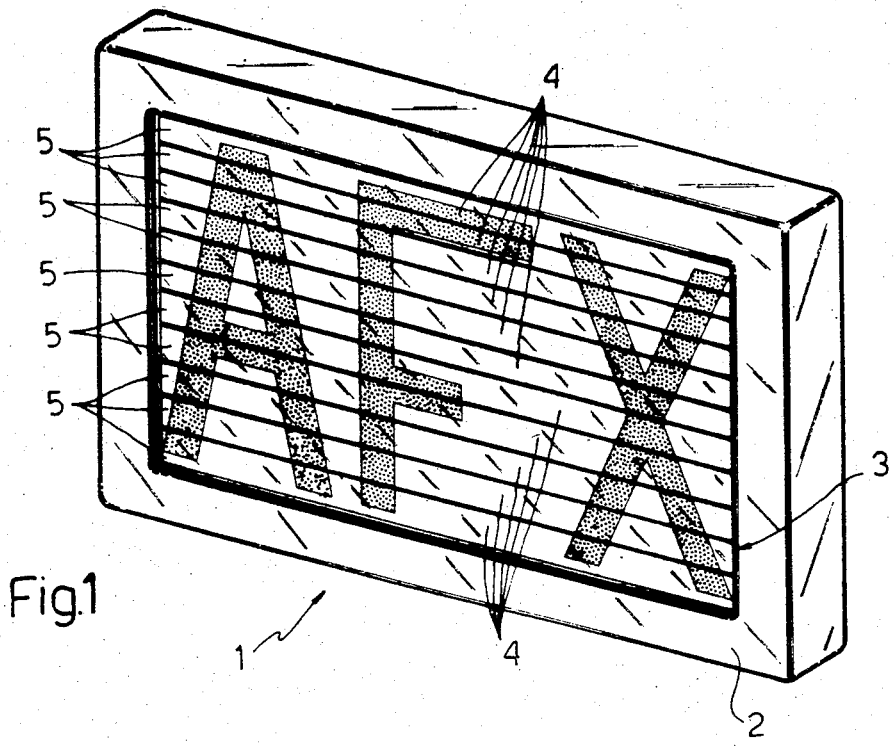
FIG. 1 is a perspective plan view of a publicity board constructed in accordance with the present invention.

In FIG. 1, the reference numeral 1 indicates overall a publicity board of the rotating prism type comprising essentially a support structure 2 defining a rectangular window 3, within which there is housed a plurality of prismatic members 4 disposed with their longitudinal axes parallel. In the illustrated example, each member 4 has a cross-section in the form of an equilateral triangle and therefore comprises three display faces, indicated by 5, arranged to carry respective portions of publicity images. In the manner described hereinafter, the prismatic members 4 are arranged to rotate about their longitudinal axis in order to cyclically cause the respective faces 5 to lie in a single display plane, namely the plane of the front surface of the window 3, in order to wholly compose the respective publicity image.

Figure 2:
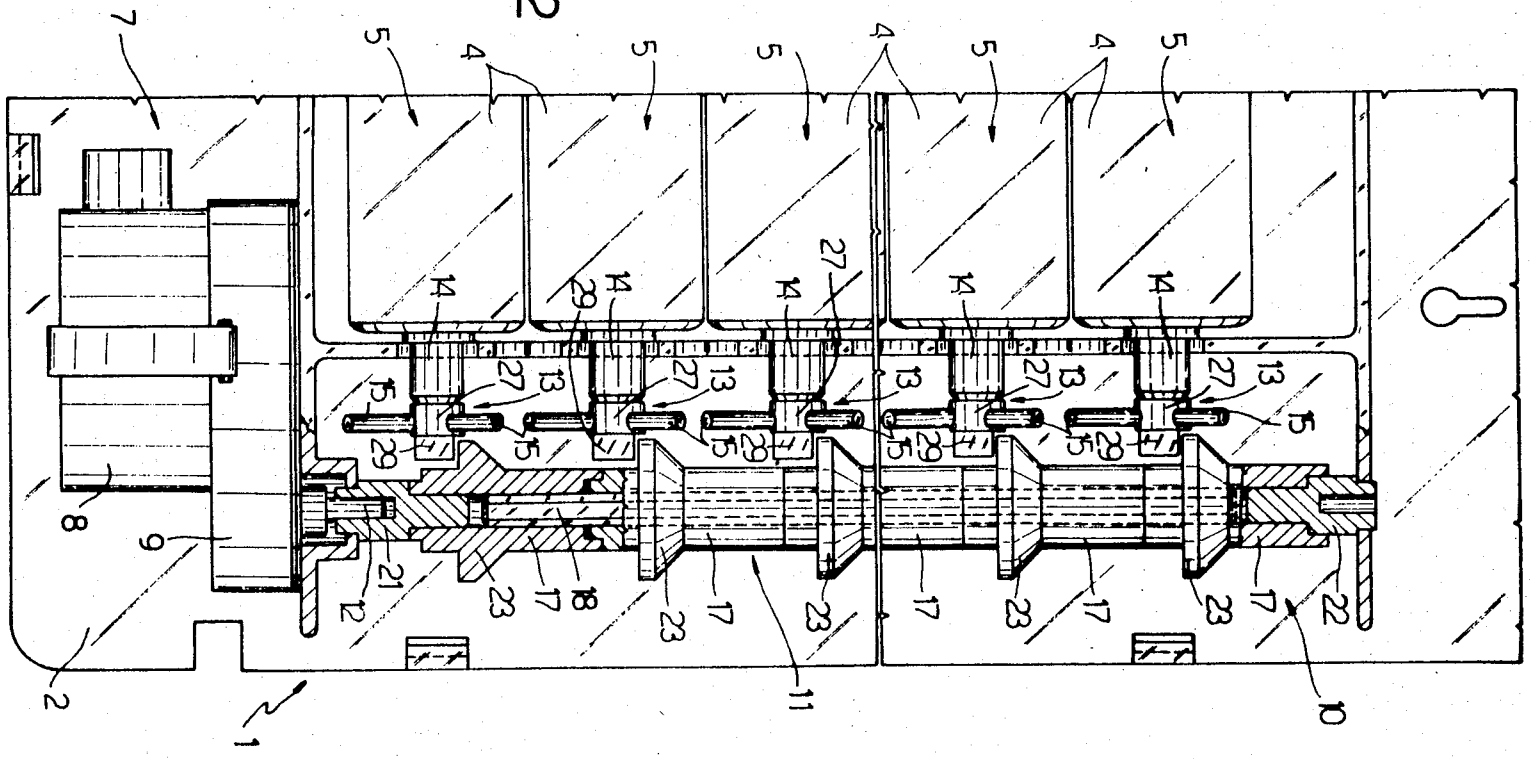
FIG. 2 is a section through the internal mechanism of the board of FIG. 1, to an enlarged scale.

With reference to FIG. 2, the publicity board 1 comprises motion generator means 7 consisting essentially of a meter 8 coupled to a reduction gear 9 and fixed to the support structure 2, and motion transmission means 10 interposed between the motion generator means 7 and the various prismatic members 4 in order to transmit said rotational motion to these latter about their longitudinal axis. According to the present invention, the motion transmission means 10 comprise essentially a modular shaft 11 angularly coupled to the output shaft 12 of the reduction gear 9, and a plurality of coupling elements 13 each of which is connected to the respective end pivot 14 of a corresponding prismatic member 4 and also carries three angularly equidistant radial appendices 15 arranged to cooperate with the modular shaft 11 in order to cause the respective prismatic member 4 to rotate each time through 120°.

With reference to FIGS. 2, 3, 4 and 5 it can be seen that the modular shaft 11 is composed of a plurality of tubular elements 17 mounted coaxial and angularly coupled to each other. Inside said element there is disposed a hexagonal stiffening bar 18, and the end elements 17 are respectively connected to the support structure 2 by essentially identical coupling pins 21, 22. The pin 21 is also angularly coupled to the output shaft 12 of the reduction gear 9. From the body of each tubular element 17 there radially extends outwards a flange 23 which when viewed in plan is in the form of a circular ring sector (see FIG. 4) which extends through a circular arc conveniently greater than 180°. Said flange is externally bounded by a cylindrical surface surmounted by a frusto-conical surface, and at one of the end edges of the lower cylindrical part comprises a bevel 24, the purpose of which is explained hereinafter.

Figure 7:
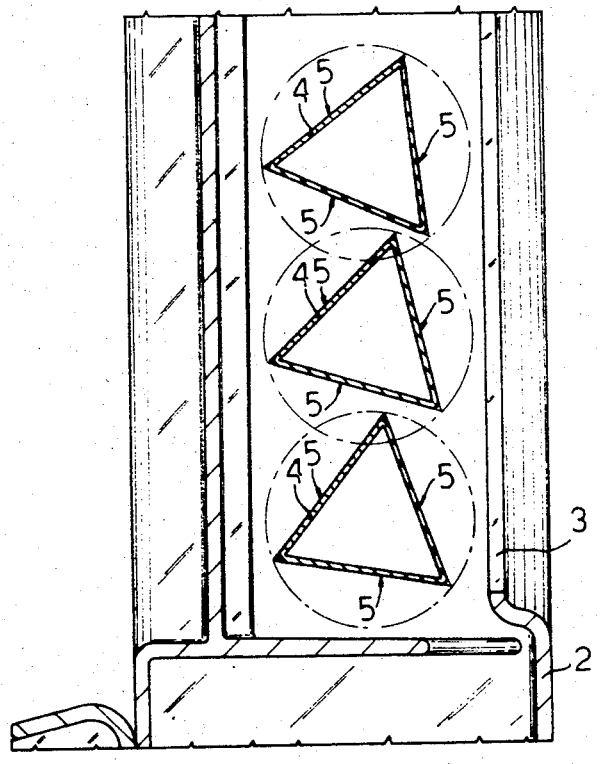
FIG. 7 is a cross-section to an enlarged scale taken through the central portion of the board of FIG. 1 when in a particular working condition.
Figure 6:
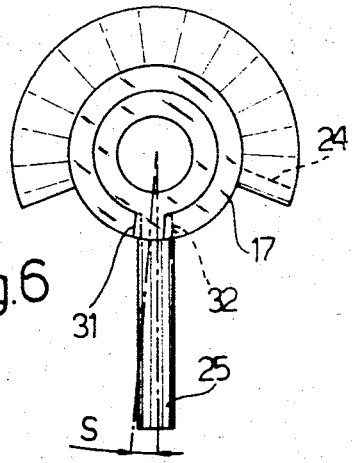
FIG. 6 is a view of a detail of FIG. 4 to an enlarged scale.

In a position equidistant from the opposing surfaces which angularly bound the flange 23, there radially extends from the body of the tubular element 18 a rod 25 having a range of action such as to interfere with the radial appendices 15 extending from the coupling elements 13. In particular, said radial appendices 15 extend from a hub 27 which at one end comprises a pin 28 coupled to the pivot 14 of the respective prismatic member 4, and at the opposite end carries a prismatic head 29 of triangular cross-section disposed within the range of action of the radial flange 23 of each tubular element 17. Finally, with reference to FIG. 6 it can be seen that adjacent tubular elements 17 are joined together by a key 31 and a corresponding seat 32 provided in the opposing ends of each tubular element 17. In particular, each key 31 and seat 32 are angularly offset in their respective tubular element 17 by an angle S conveniently of between 2° and 8°, and this leads to a phase difference between the movement of adjacent prismatic members 4 during the updating of the publicity information presented by the board 1, as shown in FIG. 7.

The operation of the publicity board 1 is simple and intuitive. When in its rest state (see FIGS. 1 and 2), the window 3 presents a publicity image constituted by an assembly of several portions carried by the faces 5 of each prismatic member 4. It is not possible to rotate the prismatic members 4 from the outside, because the prismatic head 29 which each of them carries in a position facing the modular shaft 11 interferes with the lower facing surface of the flange 23 of the corresponding tubular element 17 of said shaft 11.

Figure 3:
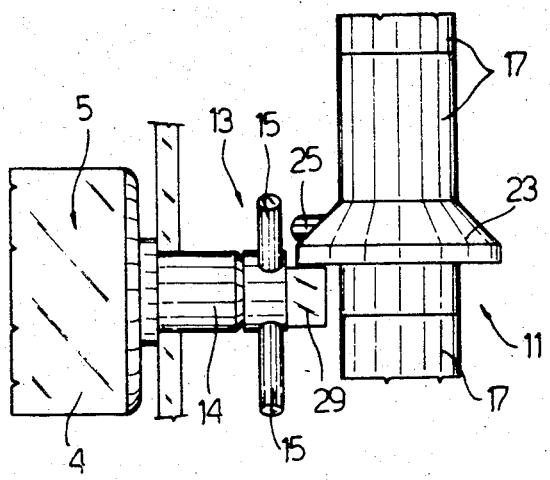
FIGS. 3, 4 and 5 are a front, side and plan view respectively of a detail of FIG. 2.
Figure 5:
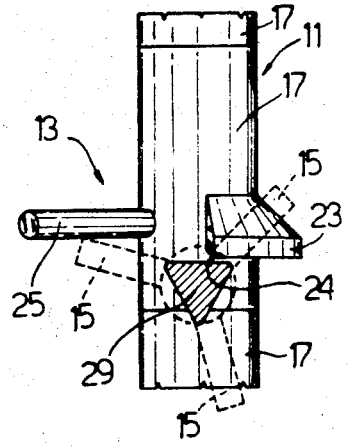
Figure 4:
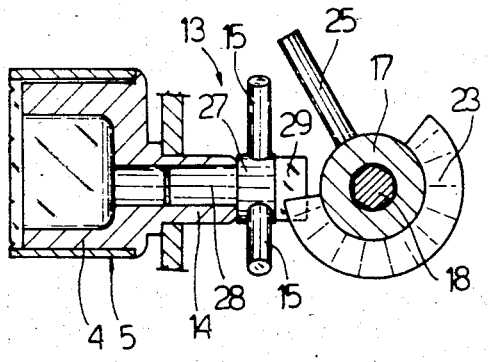

When the motor 8 is supplied with electricity, the reduction gear 9 continuously rotates the shaft 11 about its axis. With reference to FIGS. 3, 4 and 5, this rotation firstly causes the flange 23 to uncover the prismatic head 29, followed by the engagement of one of the appendices 15 by the rod 25, with the consequent 120° rotation of the hub 27 and thus also of the prismatic member 4 connected to it. When the new position is reached, corresponding to the presentation of a new publicity image through the window 3, the flange 23 is again brought into a position, as shown in FIG. 5, in which it covers the respective facing surface of the prismatic head 29 so as to prevent any further accidental rotation of this latter. The purpose of the bevel 24 present leverly on the flange 23 is to facilitate correct mutual positioning between the flange 23 and prismatic head 29. As already stated, the angular displacement between each tubular element 17 of the shaft 11 means that during the transition stage between the presentation of two publicity images, mechanical interference between the prismatic members 4 is prevented. In this respect, as can be seen in FIG. 7, during the transition stage the prismatic members rotate out of phase with each other, but without interfering even when the respective trajectories become superposed.

The advantages which can be obtained by the publicity board 1 constructed in accordance with the present invention are apparent from an examination of its characteristics. Firstly, the various components are constructed by moulding plastics material and can therefore be obtained at a relatively low cost. Moreover, no particular maintenance is required, because of which the novel transmission system used is particularly reliable overall.

Finally, it is apparent that modifications can be made to the described form of the board 1 without leaving the present invention. For example, the use of rotating members of triangular cross-section is not limitative, in that prismatic members of quadrangular cross-section could be used with suitable modifications. Generally, the prismatic member must be controlled in such a manner that the periodic rotation to which it is subjected takes place through an angle which is double the angle formed at the centre by each face of said prismatic member.

We claim:

1. A publicity board comprising:

a plurality of elongated prismatic members (4), each of said members (4) having a plurality of display faces (5), said members (4) mounted with their longitudinal axes in parallel, said members being adapted to rotate about their longitudinal axes to cause said display faces (5) to cyclically lie in a single plane;

motion generator means (7) for rotating said members (4) and having a drive shaft (12);

motion transmission means (10) coupled to said drive shaft (12), for transmitting rotating motion to said members (4), said motion transmission means (10) including an operating shaft (11), said operating shaft being coplanarly arranged with the longitudinal axes of said members and further including means (15, 27) carried by an end pivot (14) of each said prismatic member (4) for cooperating with said operating shaft (11) to cause periodic rotation of said prismatic members through an angle substantially equal to twice the angle formed at the center of said display faces (5) of said prismatic members (4), said shaft (11) arranged perpendicularly to the longitudinal axes of said prismatic members (4), said motion transmission means characterized in that said operating shaft (11) is modular and is constructed from a plurality of coaxially arranged substantially identical elements (17), said elements (17) being axially coupled together and angularly offset with a predetermined phase angle (S) between adjacent said element (17), whereby mechanical interference between said prismatic members (4) is prevented during the rotation of said members (4).

2. A board as claimed in claim 1, characterised in that each of said prismatic members (4) is controlled by a respective element (17).

3. A board as claimed in claim 1, characterised in that the value of said angle (S) of phase difference is between 2° and 8°.

4. A board as claimed in claim 1, characterised in that each of said elements (17) is tubular.

5. A board as claimed in claim 4, characterised by comprising a stiffening bar (18) located axially inside said tubular elements (17).

6. A board as claimed in claim 1, characterised in that from the body of said shaft (11) there extends at least one rod (25) arranged to act on said second means (15, 27) so as to induce successive partial rotations of said prismatic members (4).

7. A board as claimed in claim 6, characterised in that said second means (15, 27) comprises a plurality of radial appendices (15) equal in number to the number of faces of said prismatic member; said appendices (15) being arranged for rotation by said rod (25) carried by said shaft (11).

8. A board as claimed in claim 1, characterised in that said first and second means of said motion transmission means comprise respective positioning elements arranged to prevent arbitrary rotation of said prismatic members (4) when positioning has been effected.

9. A board as claimed in claim 8, characterised in that said positioning elements are essentially constituted by a radial flange extending from said operating shaft (11), and a prismatic head (29) having a structure essentially identical to that of said prismatic member (4) and extending axially from said pivot (14) at the end facing said operating shaft (11).

10. A board as claimed in claim 9, characterised in that said radial flange (23) has a cross-section in the form of a circular ring sector.

11. A board as claimed in claim 10, characterised in that said rod (25) extends radially from the body of said element (17) in a position which is equidistant from the radial surfaces bounding said flange (23) of cross-section in the form of a circular ring sector.

12. A board as claimed in claim 1, characterised in that each of said prismatic members (4) has a cross-section in the form of an equilateral triangle, and said angle of periodical rotation is 120°.

* * * * *